US005558530A

United States Patent [19]

Morello et al.

[11] Patent Number: 5,558,530

[45] Date of Patent: Sep. 24, 1996

[54] ELECTRICAL CONNECTOR ASSEMBLY HAVING A TERMINAL LOCKING BUSSING PLATE

[75] Inventors: John R. Morello, Lake Milton; Daniel H. Huff, Austintown, both of Ohio

[73] Assignee: General Motors Corporation, Detroit, Mich.

[21] Appl. No.: 270,945

[22] Filed: Jul. 5, 1994

[51] Int. Cl.[6] ..... H01R 29/00

[52] U.S. Cl. ..... 439/189; 439/744

[58] Field of Search ..... 439/189, 744

[56] References Cited

U.S. PATENT DOCUMENTS

| | | | |
|---|---|---|---|
| 3,397,384 | 8/1968 | Lawrence . | |
| 4,954,093 | 9/1990 | Nadin | 439/189 |
| 5,007,888 | 4/1991 | Goutiere | 439/189 |
| 5,106,318 | 4/1992 | Endo et al. | 439/189 |
| 5,252,088 | 10/1993 | Morello et al. | 439/271 |
| 5,356,302 | 10/1994 | Inoue et al. | 439/189 |
| 5,403,204 | 4/1995 | Chishima et al. | 439/189 |
| 5,425,656 | 6/1995 | Wahata | 439/744 |

*Primary Examiner*—P. Austin Bradley
*Assistant Examiner*—Jill DeMello
*Attorney, Agent, or Firm*—William A. Schuetz; Cary W. Brooks

[57] ABSTRACT

An electrical connector assembly comprising a connector housing made from an electrically insulating material and containing a plurality of metal terminals having a forward portion and an abutment extending transversely thereof between their ends, and a low profile metal bus plate comprising a base having a plurality of laterally spaced upstruck tangs which cooperably engage the terminals to both electrically connect the terminals to the bus plate and provide a lock to prevent reverse movement of the terminals from the housing.

6 Claims, 3 Drawing Sheets

ELECTRICAL CONNECTOR ASSEMBLY HAVING A TERMINAL LOCKING BUSSING PLATE

The present invention relates to an electrical connector assembly and, more particularly, to an electrical connector assembly having an insulated housing containing a plurality of metal pin terminals and a low profile bus plate which functions to both electrically interconnect the pin terminals and provide a lock for locking the pin terminals in place in the housing.

BACKGROUND OF THE INVENTION

One common type of electrical connector assembly comprises male and female connector housings, one of which carries a plurality of male pin terminals connected to conductor wires and the other which carries a plurality of female electrical sockets or pin terminals connected to conductor wires. When the male and female housings are mated or connected together, the male pin terminals are received within the female socket terminals to provide an electrical connection therebetween.

It is also generally known that some of the conductor wires or terminals could be eliminated by employing bus splicing bars or plates for electrically connecting a plurality of terminals together. For example, an input terminal can be connected to a plurality of output terminals via a bus splice bar.

SUMMARY OF THE INVENTION

In accordance with the provisions of the present invention, a novel electrical connector assembly is provided which includes an insulated housing having a row of spaced terminal cavities therethrough and an axially extending elongated slot coextensive with the row of cavities and in communication with the cavities via transverse axially extending slots, a plurality of metal electrical terminals, preferably pin terminals, secured to conductor wires and received in the cavities and with the terminals having forward portions provided with a transverse extending abutment intermediate its ends, and a bussing plate slidably received in the slot and having upstruck tangs. The bus plate upon being inserted into the slot of the housing has its tongs engage the forwardmost portions of the terminals, and then be deflected by the transversely extending abutments on the terminals until the tangs clear the abutments whereupon they snap behind the transversely extending abutments to again engage the forward portion of the terminals when fully inserted in the housing. The tangs serve to both electrically connect the terminals to the bus plate and to provide a lock to prevent reverse movement of the terminals relative to the housing.

Another feature of the electrical connector assembly is that the elongated slot in the connector housing is U-shaped in cross section and the bus plate is U-shaped in cross section so that the bus plate can only be inserted into the housing in one position to insure connection of the bus plate with the male pin terminals.

Yet another feature of the present invention is that the housing and the bus plate have cooperable abutments to position the latter in the housing upon being inserted into the slot of the housing. The cooperable abutments comprise a manually manipulatable flange extending transversely or perpendicularly to the bus plate and an end face on the connector housing which engage each other upon the bus plate being fully inserted into the elongated slot. Another cooperable abutment comprises a transversely extending nib or projection on the housing and extending into the elongated slot and a through aperture in a forward portion of the bus plate. When the bus plate is inserted into the elongated slot, it rides over the nib until the nib is positioned adjacent the aperture whereupon it falls over the nib to provide a lock to hold the bus plate in place on the housing, the side edge of the bus plate defining the aperture engaging the side edge of the nib to provide the abutting surfaces.

Still another feature of the present invention is that the housing is provided with integral deflectable arms or fingers which extend into the terminal cavities and which are deflectable and lock behind the transverse abutments on the forward portions of the terminals to lock the terminals in place within the housing to provide a primary lock for the terminals and in which the tangs of the bus plate also lock behind the abutments on the terminals to provide a secondary lock for holding the terminals within the housing.

An additional feature of the present invention is to provide a forward stop on the housing for preventing over-insertion of the terminals when being inserted from its rearward end towards its forward end and with the deflectable arms or fingers on the housing locking the transverse abutment on the terminal between the forward stop and the arms.

The present invention further resides in various novel constructions and arrangement of parts, and further objects, novel characteristics and advantages of the present invention will be apparent to those skilled in the art to which it relates and from the following detailed description of the illustrated, preferred embodiment thereof made with reference to the accompanying drawings forming a part of this specification and in which similar reference numerals are employed to designate corresponding parts throughout the several views, and in which.

Figure 1:
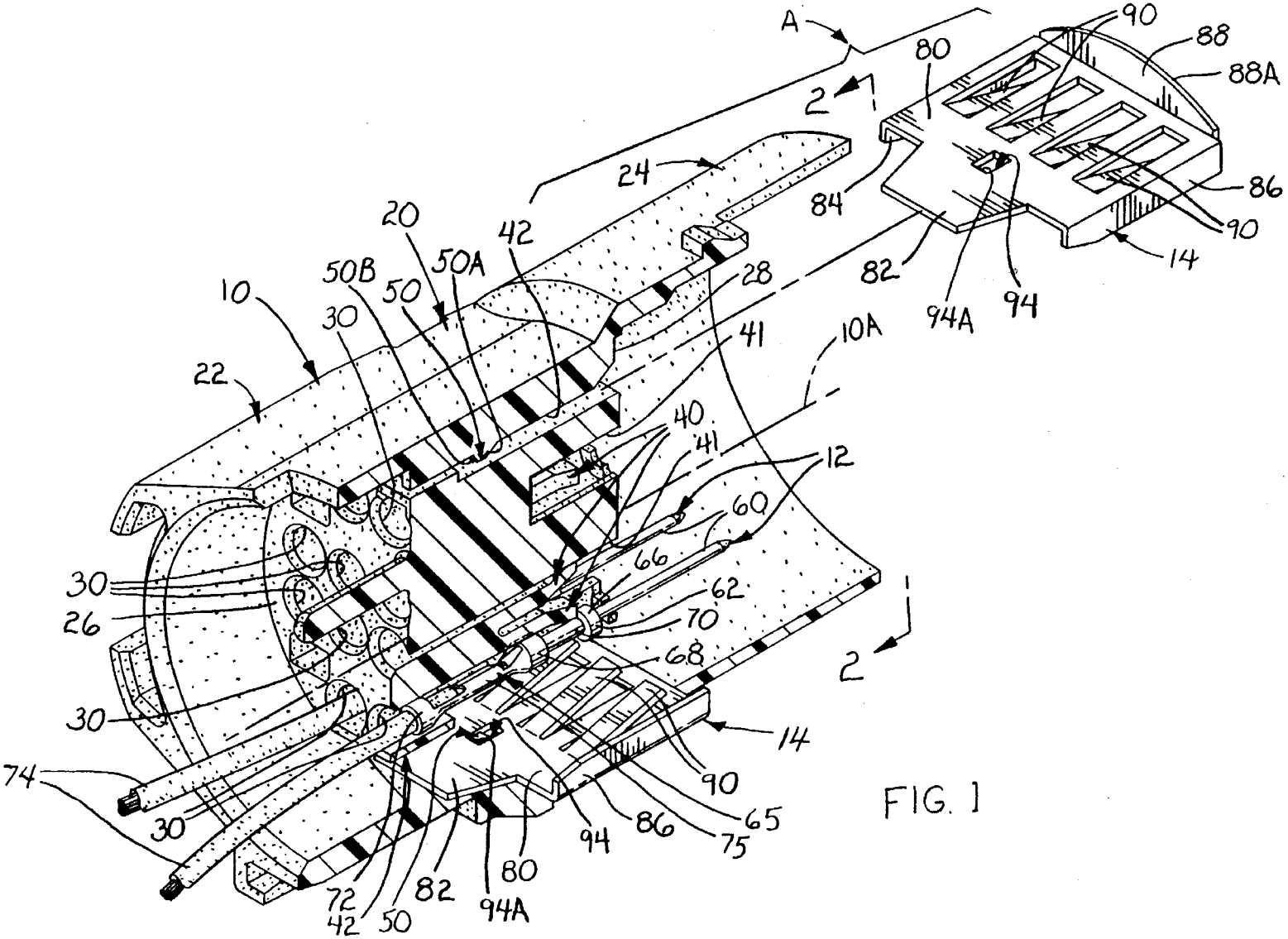
FIG. 1 is an exploded perspective view, with parts shown in section, of the novel electrical connector assembly of the present invention.

Referring to the drawings, a novel electrical connector assembly A is thereshown. The novel electrical connector assembly A comprises, in general, a connector housing 10 made from a suitable electrically insulating material, a plurality of male pin terminals 12 carried by the housing 10 and a metal bus plate 14 which is slidably received within the housing and which functions to both electrically interconnect a plurality of the electrical terminals 12 together but also to lock the terminals 12 in place within the housing 10.

Figure 2:
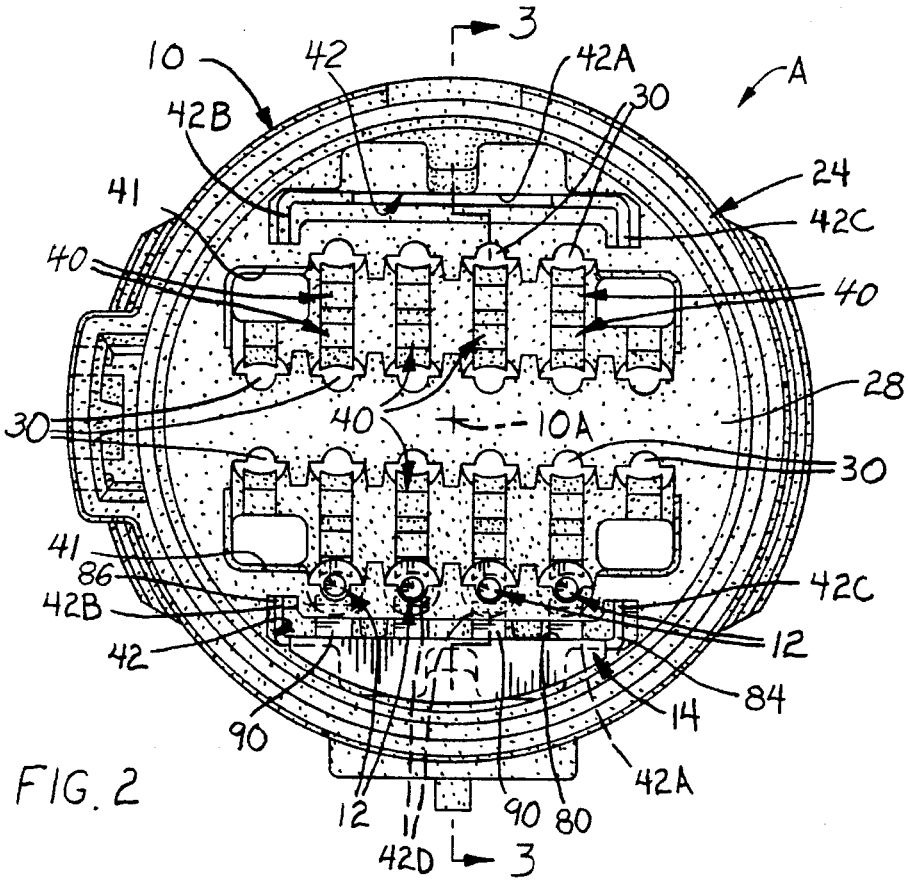
FIG. 2 is an end elevational view of the electrical connector assembly of the present invention and looking in the direction of the arrows 2—2 of FIG. 1.
Figure 3:
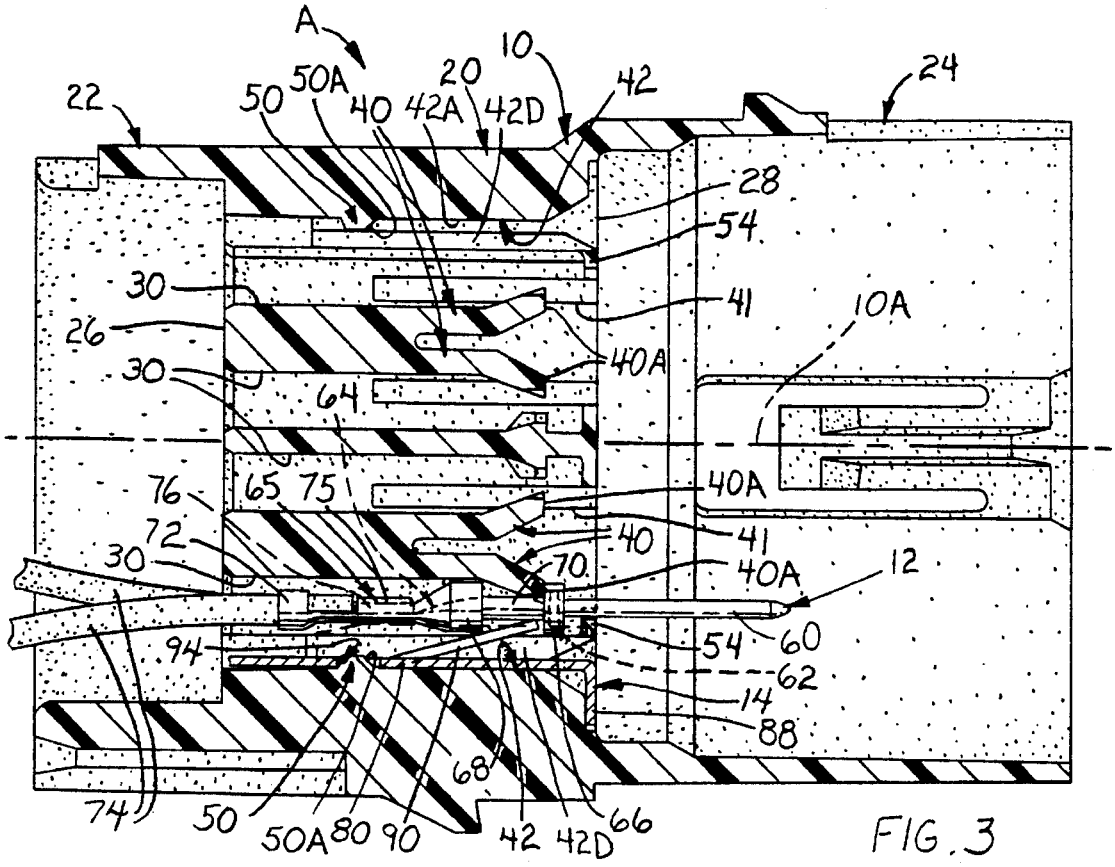
FIG. 3 is an axial sectional view of the electrical connector assembly shown in FIG. 2 and looking in the direction of the arrows 3—3 of FIG. 2.
Figure 4:
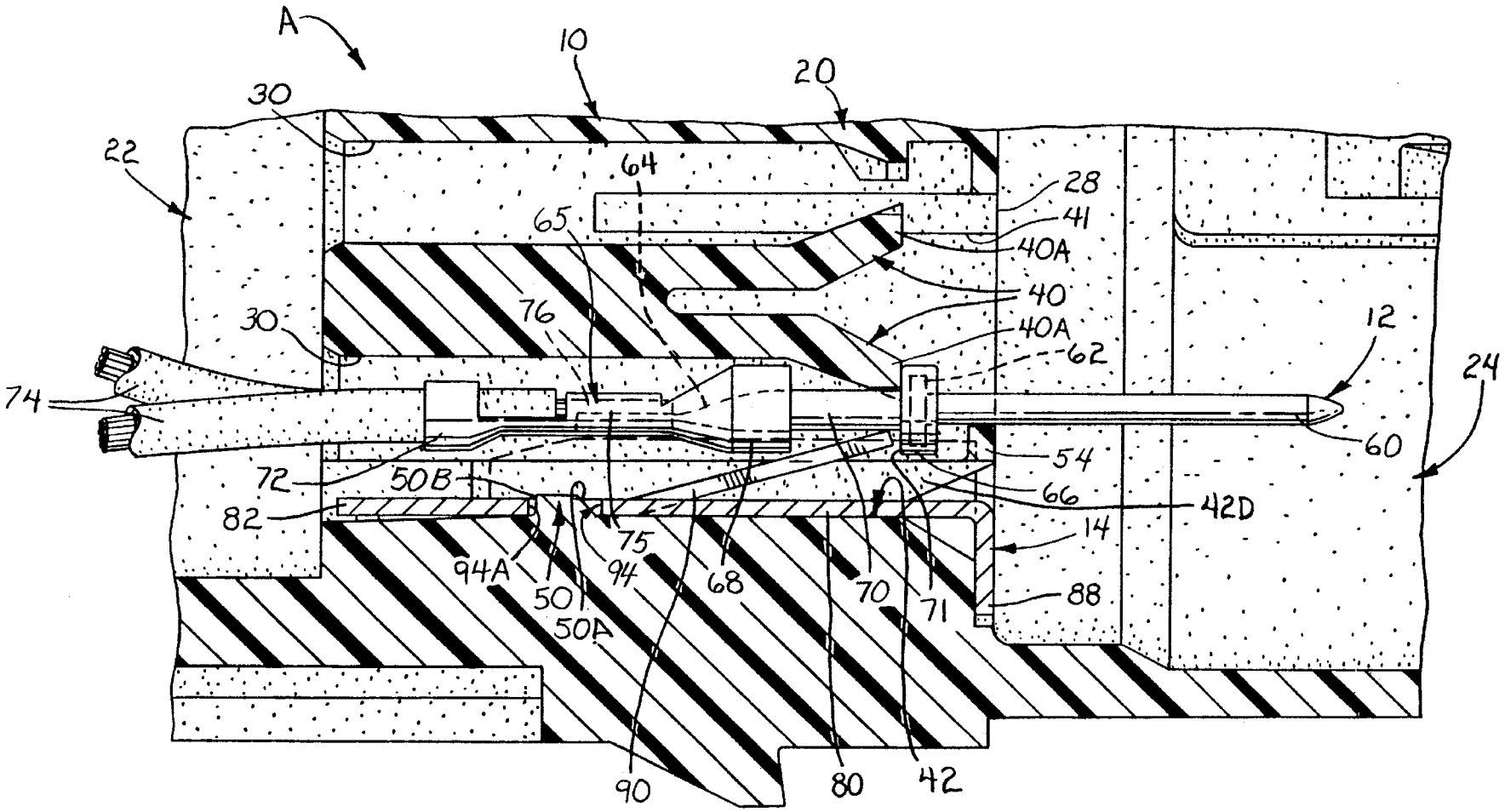
FIG. 4 is an enlarged fragmentary sectional view of part of the electrical connector assembly shown in FIG. 3.

The housing 10 can be molded from any suitable or conventional electrically insulating material, such as plastic, and is shown in the drawings as being generally cylindrical in shape. The housing 10 comprises a main body 20 integral with a rear shroud 22 and a forwardly extending shroud 24. The main body 20 has a planar rear end face 26 and a generally planar forward end face 28. The main body portion 20 also has upper and lower rows of terminal cavities 30 extending therethrough and a pair of intermediate rows of terminal cavities 30 extending therethrough, the cavities 30 all extending in a direction parallel to the longitudinal axis 10A of the connector housing 10. The rows of cavities 30 are linear from left to right, as viewed in FIG. 2, but each of the individual cavities 30 being spaced apart from each other. The body portion 20 also includes deflectable lock arms or fingers 40 which are integral with the body portion 20 and which extends through slots 41 in a side wall defining the cavity 30 so that the free end 40A of the finger 40 is located within the cavity 30. It should be noted that there is a deflectable finger 40 for each of the cavities 30 extending through the body portion 20 and vertically adjacent rows of cavities 30 have their fingers 40 opposed, as shown in FIGS. 3 and 4, and for a reason to be hereinafter more fully described.

The main body portion 20 adjacent its top end bottom rows of terminal cavities 30 has elongated axially extending slots 42 therethrough. The slots 42 have a main portion 42A which is rectangular, as viewed in cross section, and a pair of end portions 42B, 42C which extend perpendicular to the main portion 42A so as to define an overall U-shaped slot 42 extending axially through the main body portion from its forward face 28 to its rear or rearward face 26. The main portion 42A is equidistantly spaced from the cavities 30. The main body portion 20 also has axially extending transverse passages or slots 42D for communicating the terminal cavities 30 and the main portion 42A of the elongated slot 42. The transverse slots 42D are separated from each other and serve a purpose to be hereinafter more fully described. The main body portion 20 also includes a pair of nibs 50, one of which extends downwardly into the slot portion 42A of the slot 42 at the upper end of the connector housing 10 and the other of which extends upwardly into the slot portion 42A of the lower slot 42, as viewed in FIGS. 2 and 3. The nibs 50 are located midway between the opposite lateral sides of the slot portions 42A of the slots 42, as best viewed in FIG. 1, and each of the nibs 50 has a tapered entry ramp or surface 50A which faces toward the end face 28 of the body portion 20 of the connector housing 10 and for a reason to be hereinafter more fully described.

The housing body portion 20 adjacent its forward end 28 also includes transversely extending abutments or stops 54 extending into the terminal cavities 30 which serve as forward stops for the terminals 12 when the latter are received within the terminal cavities 30.

The terminals 12 are of a two piece metal construction. The terminals 12 could be of any suitable or conventional construction, but preferably are pin type terminals, such as shown and described in detail in U.S. Pat. No. 5,252,088, issued Oct. 12, 1993, and assigned to the same assignee as the present invention. The terminals 12 preferably comprise a solid forwardly extending pin member 60 having a collar 62 intermediate its ends and a rearward dish portion 64. The terminals 12 also include a stamped sheet metal member 65 which is stamped and rolled to provide a hollow circular rib 66 at its forward end which surrounds the collar 62 and a circular rib 68 at a location rearwardly therefrom. The ribs 66, 68 define a recess 70 therebetween and the rib 66 and collar 62 define a radially extending abutment 71. The rolled second member 65 also includes a crimping flange 72 for crimping onto an insulated conductor 74 and a spaced crimping wing 75 for crimping the bare end 76 of the insulated conductor 74 to the dished end portion 64 of the terminal portion 60 and the terminal. Although the terminals 12 have shown and described herein as being cylindrical pin terminals, it should be understood that the terminals could be of any other suitable shape.

The terminals 12 are adapted to be connected to the housing 10 by inserting the same from the rearward face 26 through the terminal cavities 30 from left to right, as viewed in FIGS. 3 and 4. As the terminals 12 are moved from left to right in the cavities 30, the collars 66, 62 thereof will engage the deflectable fingers 40 and deflect the same away or radially outwardly until the collars 66 clear the fingers 40 whereupon the fingers 46 will return to their normal free state position and lock behind the collars to provide a primary lock for preventing reverse movement of the terminals 12. The forward stops 54 provide a forward limit of movement of the terminals 12 within the cavities 30 and when the fingers 40 engage their rearward side of the abutments 71, the terminals are locked between the forward stops 54 and the fingers 40.

The metal bus plate 14 comprises a one piece sheet metal member stamped to the configuration shown in FIG. 1. The sheet metal member 14 comprises a planar base 80 which is generally rectangular in shape, and has a forwardly extending portion 82 and a pair of sides 84, 86 which extend perpendicular to the base 80 along the opposite lateral sides thereof. The base 80 and the sides 84, 86 are of a generally U-shaped cross sectional shape and are adapted to be slidably received within the slotted openings 42 in the housing 10. The bridge plate 14 also includes a plurality of laterally spaced upstruck tangs 90. The tangs 90 are rectangular in shape and are stamped or lanced out of the sheet metal base and bent so as to define acute included angles between the sheet metal base 80 and the plane of the tangs 90. The tangs 90 are all lanced and bent in the same direction and are integral with the base 80 adjacent its center.

In addition, the bridge plate 14 includes a manually manipulatable flange 88 at one end which is bent at right angles to the base 80 and extends in the direction opposite the direction the tangs 90 are bent. The flange 88 has an arcuate side edge 88A so as to be complementary to the housing. Also, the bridge plate 80 has a rectangular aperture 94 stamped therethrough, and for a reason to be presently described.

The bridge plate 14 is adapted to be manually grasped by its flange 88 and slidably inserted into the slotted openings 42 from right to left, as viewed in FIGS. 1, 3 and 4. The bridge plate 14 can only be slid into the slotted opening 42 when the base 80 is aligned with the slotted portion 42A and the flanges 84, 86 are aligned with the slotted portions 42B, 42C so that it cannot be improperly installed into the body portion 20 of the housing 10. When the bridge plate 14 is inserted into the housing portion 20, the tangs 90 will be received within the slotted passages 42D and will engage the forward portion of the male pin terminals 12. As the bridge member 14 is further slid into the slotted openings 42, the forward portion 82 thereof will engage the ramp 50A of nib 50 extending transversely of the bottom of the slotted opening portion 42A and cause the bridge member 14 to be deflected upwardly, as viewed in FIGS. 3 and 4. Shortly thereafter, the tangs 90 will engage the collars 66 of the terminals 12 and be deflected downwardly. When the tangs 90 of the bridge plate pass over the collars 66, the tangs 90 will spring back and snap into engagement with the male pin terminal 12 and be disposed within the recess 70. Around the same time, the spring bias of the tang 90 will cause the base 80 of the bus plate 14 to move downwardly when the window or aperture 94 of the bus plate is disposed over the nib 50 to lock the bridge plate 14 to the body portion 20 of the housing 10.

It should be noted that the edge or side wall 94*a* of the base 80 defining the aperture 94 will engage the side surface 50B of the nib 50 to prevent movement of the bridge member 14 to the right, as viewed in FIG. 4. The side wall 94A defining the aperture 94 and the nib 50 thus provide a first abutment means for positioning and preventing removal of the bridge plate 14 from the housing portion 20. Also the depending flange 88 and the end face 28 will provide a second abutment means to prevent insertion of the bridge member 14 past its intended position within the body portion 20 of the housing 10. The bridging member 14 can only be removed from the housing 10 by deflecting the tangs 90 downwardly to enable the forward end 82 to be raised and the bridge plate 14 to be pushed forwardly towards the forward end 28.

Moreover, it should be noted that the bus plate 14 serves a dual purpose of electrically interconnecting a plurality or all of the male pin terminals 12 located in the associated row of pin terminals together and also serves as a secondary lock to lock the pin terminals 12 in place and prevent removal therefrom from right to left, as viewed in FIGS. 3 and 4.

It should be further noted, that the flexible fingers 40 in the housing 20 could be eliminated, if desired, and that the pin terminals 12 could be held solely in place against their forward stops 54 by the tangs 90 of the bridge plate 14. The tangs 90 would then constitute primary locking tangs 90 rather than functioning as a secondary lock in addition to the flexible fingers 40.

It should also be noted that although the electrical connector assembly A has been described with the pin terminals connected within the cavities 30 first and thereafter the bridge plates 14 being connected thereto to simultaneously connect the pin terminals 12 in each associated row together, it is also possible that the bridge plates 14 could be positioned within their cavities or slots 42 first and then thereafter individual metal pin terminals 12 inserted through their cavities 30 from left to right, as viewed in FIG. 3.

It should be further noted that even though the rows of cavities 30 in the housing 10 have been shown as being linear rows and with the slots 42 also being primarily linear and closely spaced therefrom, it is possible that various terminal cavities 30 could be located on a circular arc and that the slot 42 could also be circular and that the bridge bus plate 14 could be made into a circular arc.

The electrical connector assembly A, as shown in FIGS. 1 and 3, is adapted to be connected to a mating electrical connector assembly (not shown) having a plurality of female pin or socket type terminals which are adapted to mate with the forward portions of the male pin terminals 12, such the mating connector shown in the aforementioned U.S. Pat. No. 5,252,088 in FIG. 7 thereof. Resort may be had to this patent for a complete description of the mating connector. As noted in this patent, the mating connector would have forwardly projecting portions which would be engaged between the deflectable fingers 40 on the housing to further lock the fingers against movement and lock the pin terminals 12 in place.

From the foregoing, it should be apparent that a novel, electrical connector assembly has been provided. The novel bus plate 14 is a thin, generally planar member which can be readily stamped and bent to its final configuration, low cost, of a low profile, and is easy to manipulate and assemble to its connector housing 10. Another advantage is that existing connector housings can be employed with only minor modifications thereto, i.e., providing an axially extending, elongated slot and axially extending transverse slots, without requiring a redesign of the entire housing. The use of the novel bus plate also enables the number of conductor wires either to be reduced, for example, one input terminal electrically serving to electrically connect multiple output terminals or to increase the number of circuits for a given size connector assembly. In addition, the use of a tanged bus plate provides both an electrical interconnect and a locking of the pin terminals in place. Thus the deflectable lock fingers 40 integral with the housing 10 for locking the terminals 12 in place could be eliminated, if desired.

Although the illustrated embodiment hereof has been described in great detail, it should be apparent that certain modifications, changes and adaptations may be made in the illustrated embodiment, and that it is intended to cover all such modifications, changes and adaptations which come within the spirit of the present invention.

We claim:

1. An electrical connector assembly comprising:

a connector housing made from an electrically insulating material, said housing having a plurality of spaced terminal receiving cavities extending therethrough, an axially extending elongated slot extending substantially coextensive with said plurality of spaced terminal receiving cavities and spaced substantially equidistantly from each of said plurality of cavities and being in communication with said cavities via axially extending transverse passages, a plurality of metal terminals connected to conductor wires, each of said metal terminals having first and second ends, each of said terminals being received in one of said terminal receiving cavities in said housing and having a forward portion and an abutment extending transversely outwardly of said forward portion intermediate said ends, and a metal bus plate comprising a base shaped complementary with said elongated slot in said housing and having a plurality of laterally spaced upstruck tangs, said bus plate being insertable into said slot and with the tangs being received through said transverse passages and extending into said terminal receiving cavities in said housing, cooperable abutments on said housing and said bus plate to position said bus plate in said housing upon being inserted into said slot, said tangs on said bus plate being sequentially engageable with said forward portion of said terminals, deflectable by said transversely extending abutments on said terminals and adapted to be snapped behind the transversely extending abutments to again engage the forward portions of said terminals when either the terminals or bus plate are inserted into the housing with the other already in the housing whereby the tangs serve the dual function of electrically connecting the terminals to the bus plate and providing a lock to prevent reverse movement of the terminals.

2. An electrical connector assembly as defined in claim 1 and wherein the cavities in the housing are in a linear row, the slot in the housing is rectangularly shaped and the bus plate has a flat rectangularly shaped base.

3. An electrical connector assembly as defined in claims 1 or 2, and wherein said elongated slot in said housing includes transversely extending portions to define a U-shaped cross-section and said bus plate has flanges at its opposite lateral edges which extend perpendicular to its base and which are slidably receivable within said transversely extending portions of said slot.

4. In an electrical connector assembly, as defined in claim 1, and wherein said cooperable abutments on said housing and bus plate for positioning the bus plate in the housing comprise an end face surface on the housing adjacent the forward portions of the terminals and a depending flange extending transversely of said base of said bus plate for engaging said end face when the bus plate is inserted into the housing.

5. In an electrical connector assembly, as defined in claim 1, and wherein said cooperable abutments on said housing and bus plate for positioning the bus plate in the housing comprise a side edge defining a through aperture in said base and a side surface of an abutment nib extending transversely from a bottom surface of said elongated slot, said base plate riding over said abutment nib until the aperture in the base plate is aligned therewith whereupon said abutment nib is received in the aperture and further relative movement between the base plate and the housing is prevented.

6. An electrical connector comprising:

a connector housing made from an electrically insulating material and having a linear row of spaced terminal receiving cavities extending therethrough, a plurality of metal pin terminals connected to conductor wires, each of said metal pin terminals having first and second ends, each of said terminals being received in one of said terminal cavities in said row and each of said pin terminals having a forward portion and a radially outwardly extending collar intermediate said ends, said housing also having an elongated slot disposed substantially parallel to said cavities and located closely adjacent thereto, said slot being in communication with said cavities via transverse passages in said housing, a metal bus plate comprising a generally planar base having a plurality of laterally spaced upstruck tangs, said base of said bus plate being insertable into said slot and with the tangs being received through said transverse passages and into said terminal cavities in said housing, cooperable abutments on said housing and said bus plate to position said bus plate in said housing when fully inserted into said slot, said tangs on said bus plate being deflectable by said collars on said forward terminal portion and then engaging the forward terminal portions and locking behind the collars when either the terminals or bus plate are inserted into the housing with the other already in the housing whereby the tangs serve the dual function of electrically connecting the terminals to the bus plate and providing a lock to prevent reverse movement of either the terminals or the bus plate.

* * * * *